US007566258B2

(12) United States Patent
Connolly

(10) Patent No.: US 7,566,258 B2
(45) Date of Patent: Jul. 28, 2009

(54) INTERACTIVE PLUSH TOY

(76) Inventor: Sally Lee Connolly, 305 Ashlar Dr., Napa, CA (US) 94558

( * ) Notice: Subject to any disclaimer, the term of this patent is extended or adjusted under 35 U.S.C. 154(b) by 653 days.

(21) Appl. No.: 11/271,951

(22) Filed: Nov. 14, 2005

(65) Prior Publication Data

US 2006/0105671 A1 May 18, 2006

Related U.S. Application Data

(60) Provisional application No. 60/628,432, filed on Nov. 17, 2004.

(51) Int. Cl.
*A63H 3/38* (2006.01)

(52) U.S. Cl. ..... 446/485

(58) Field of Classification Search ..... None
See application file for complete search history.

(56) References Cited

U.S. PATENT DOCUMENTS

| | | | | |
|---|---|---|---|---|
| 928,744 | A | 7/1909 | Fisher | |
| 2,098,166 | A | 11/1937 | Rubenstein et al. | |
| 2,794,298 | A * | 6/1957 | Mason | 446/392 |
| 2,954,640 | A | 10/1960 | Catalano | |
| 3,898,383 | A * | 8/1975 | Herbits | 362/253 |
| 4,263,743 | A | 4/1981 | Hanson et al. | |
| 4,305,223 | A * | 12/1981 | Ho | 446/392 |
| 4,464,861 | A * | 8/1984 | Fogarty et al. | 446/370 |
| 4,547,171 | A * | 10/1985 | Horimoto | 446/370 |
| 4,585,424 | A | 4/1986 | DeMars | |
| 4,734,074 | A | 3/1988 | Kinberg et al. | |
| 4,752,273 | A * | 6/1988 | Woods | 446/392 |
| 4,777,938 | A * | 10/1988 | Sirota | 600/27 |
| 5,114,376 | A | 5/1992 | Copley et al. | |
| 5,439,407 | A * | 8/1995 | Friedel | 446/219 |
| 5,791,965 | A * | 8/1998 | Kim | 446/219 |
| 6,048,209 | A | 4/2000 | Bailey | |
| 6,165,037 | A * | 12/2000 | Van Zant | 446/219 |
| 6,511,214 | B1 | 1/2003 | Parsons et al. | |
| 6,514,117 | B1 | 2/2003 | Hampton et al. | |
| 6,663,393 | B1 | 12/2003 | Gahly | |

FOREIGN PATENT DOCUMENTS

| | | | |
|---|---|---|---|
| DE | 29720813 U1 | * | 1/1998 |
| EP | 441566 A1 | * | 8/1991 |
| JP | 2000313199 A | * | 11/2000 |

* cited by examiner

*Primary Examiner*—Ronald Laneau
*Assistant Examiner*—Tramar Harper
(74) *Attorney, Agent, or Firm*—Donald Grant Kelly

(57) ABSTRACT

A plush toy playfully animates animals, insects, reptiles, prehistoric creatures and the like having small light emitting diodes representing eyes. The eyes are fabricated LED housings with external surfaces constructed as substantially translucent covers having generally opaque regions representing iris/pupil and eyelid areas. The toy is provided with internal circuitry including a pressure switch activating a battery source for the LED's. A timer sets activation cycles. The fabrication of the eyes as covered housings results in a plush toy with softly illuminated eyes, safely enjoyed by children as nighttime companions in lieu of nightlights. This toy is particularly useful in a method of inducing a young user's sleep. When the circuit timer runs a cycle, the diode eye glow fades as the plush toy "falls asleep." The user may repeat the cycles until her/his own sleep is induced.

6 Claims, 2 Drawing Sheets

INTERACTIVE PLUSH TOY

CROSS REFERENCE TO RELATED APPLICATIONS

This application is entitled to the benefit of provisional patent application Ser. No. 60/628,432; such benefit is hereby claimed under 35 USC 119(e).

STATEMENT REGARDING FEDERALLY SPONSORED RESEARCH OR DEVELOPMENT

Not applicable.

REFERENCE TO SEQUENCE LISTING

Not applicable.

REFERENCE TO MICROFICHE APPENDIX

Not applicable.

BACKGROUND OF THE INVENTION

This invention relates to toys and the like, typically enjoyed by users such as children and collectors, and in particular those suited to very small children. More specifically, the present invention relates to interactive toys and the like which are electromechanically adapted to provide a response or reaction when engaged by users.

The present invention relates particularly to toys with battery powered illumination features, and a unique method of use thereof. Such toys typically would be of a size and weight to be readily manipulated by a small child, or easily stored nearby in a location ready-for-play or interaction.

For generations, conventional toys, whether plush, stuffed or of the more rigid variety, have fascinated children and collectors alike. Popular toys and collectables have included plush or soft varieties ranging from the timeless Teddy Bear to the more contemporary BEANIE BABY®.

Still others of a more rigid nature are exemplified by CABBAGE PATCH®, BARBIE®, GI Joe® and Furby® dolls. Toy planes, trucks and cars may also be animated with facial (human-like) features such as eyes, noses, mouths, and ears, and may also be afforded an invitingly soft pushiness so as to join the space traditionally filled by the "Teddy."

From a review of the history of commercially available toys and collectables of the types described above it is evident that continuous efforts, many of those successful, have been undertaken to enhance their play value especially where small children are concerned. For example, plush and rigid toys alike may be provided with flexible limbs and other articulation features. With the help of clever inventors, such toys may walk, bark, moo, sing, and even blush on command.

Many toys of this type are equipped with bells, rattles, squeakers, voice boxes, sirens, and a wide range of other sound producing elements and recorded message/playback devices. Recent high-tech features even enable dolls and/or plush toys to react to ambient conditions or to the presence of, or signals from, other similarly equipped toys. Toys now perform certain robotic tasks, simulate a conversation, and sense light and darkness. Such toys can be both entertaining and demanding.

Toys also may be equipped to make, or emit, light themselves. Devices have been devised to accessorize and enhance toys from the earliest days of light bulbs to the more recently introduced light emitting diodes. Lighting accessories play different roles in different applications. For example, they may provide toys, dolls and plush/stuffed animals with dazzling decorative features, or simply suggest humanesque qualities of character and warmth. They may generate entertaining light shows, or simply illuminate a room or pathway.

For example, Bailey's U.S. Pat. No. 6,048,209 presents a doll designed to provide an interactive experience for a caretaker as the doll demands feeding, picking up, and rocking. The doll communicates its needs by LED (light emitting diode) eyes. The eyes are lit when the doll is "awake." A crying sound is provided by a speaker that further offers burping sounds following "feeding." The LED changes colors and blinks in a coded manner to signal the doll's "needs." Of course, this doll is not for very young children or infants.

Gahly's U.S. Pat. No. 6,663,393 shows another high-tech version of an interactive doll. Eye and lip movements are simulated as well as skin color changes. An electromechanical device controlled by a micro-processor enables the eye and lip movements. Skin color changes are implemented using a plurality of LED's in various colors located inside the doll and also controlled by the microprocessor.

In U.S. Pat. No. 6,514,117, Hampton et al. show yet another high-tech interactive doll. This is believed to be one of the reactive Furby® line, and includes an audio sensor in the form of an interior microphone. Between the animal's eye openings a light sensor is mounted between an IR transmitter element and IR receiver element. This permits communication between a plurality of similarly equipped toys. Like the inventions of Gahly and Bailey, discussed above, the Hampton et al. toy is for action play, as compared to comforting, and apparently not for very young children.

Catalano, in U.S. Pat. No. 2,954,640, illustrates a doll that can be made to "cry" by pumping fluid from an internal container and through conduit outlets positioned adjacent the doll's eyes. In U.S. Pat. No. 5,114,376, Copley et al. illustrate a stuffed toy having an animal-shaped body and including a belly portion that can be illuminated. Electrical circuitry and a power source, triggered by a touch sensor of a well known variety, generate a current flow to illuminate a dome-shaped member at the belly portion. A timer circuit automatically turns of the illumination source a predetermined time after is has been activated by touching the touch sensor.

Illustrated by DeMars in U.S. Pat. No. 4,585,424 is another animal-shaped toy (in this instance a bear is simulated) equipped with imaginative lighting that provides the bear with a bashful demeanor. Lamps are positioned behind the bear's face and activated by a manual pressure switch. As the lamps illuminate, the bear appears to blush.

Fisher, in U.S. Pat. No. 928,744 shows an early $20^{th}$ Century version of a stuffed bear, provided with a lighted nose and movable jaw. An external switch activates the animal's nose and jaw. It is not uncommon to use electric light bulbs or, more recently, LED's to represent the eyes of a doll, stuffed animal or other novelty toy. For example, in U.S. Pat. No. 4,263,743 Hanson et al. depict a novelty toy in the form of a skull having lights placed in the eye sockets, and made to generate different shades of color. Rubenstein's U.S. Pat. No. 2,098,166 illustrates a combined tail-wagging, eye blinking device where lights are placed in a simulated dog's head.

Kinberg et al. present U.S. Pat. No. 4,734,074 demonstrating a stuffed toy simulating an animated creature, as for example an owl. The creature includes eyes depicted by light bulbs or LED's of the blinking variety. The body of the device is formed of a resilient or flexible material such that when pressed it will return to its original shape. Within the body is a collapsible bellows associated with a voice box that will generate a sound associated with the animated creature.

Also associated with the bellows of the Kinberg et al. device is an electrical circuit and power source connected with the blinking light bulbs or LED's. This is meant to be sufficiently interesting to a small child who would squeeze the toy so as to force air through the voice box thus generating a simulated creature sound (e.g., a "hoot"). Simultaneously with the voice box sound or, as suggested, independently, interconnection between the power source and bulbs/LED's will activate the blinking lights.

Kinberg et al. go on to state that this joint activity (i.e., blinking lights and sound) greatly adds to the play value of the device and enhances the child's enjoyment. While this device would be entertaining, it could hardly be comforting. Further, this toy lacks concern for safety measures with respect to exposed bulbs/LED's. This toy, in Applicant's estimation, would not be a preferred toy for a small child's bed.

Unlike other toys discussed above, patentee Woods recognizes the hazards of exposed bulbs/LED's in his depiction, in U.S. Pat. No. 4,752,273, of yet another toy configured as a doll or other animal. Woods' toy includes a pair of eyes fashioned with two flashlight bulbs. These bulbs are mounted within pupil passages in the toy's eyes and connected to a source of electrical energy by means of an externally operated switch. As a safety feature, the passages are restricted to prevent accidental removal of the bulbs. The Woods toy and others discussed herein as having lights or diodes replicating eyes fall short in the simulation of eyes.

U.S. Pat. No. 6,511,214 granted to Parsons et al. is referenced herein for its discussion of diodes powered by batteries and controlled by pressure switches. Of particular interest is the discussion of well known micro light technology involving diodes and pressure switches, and the improvements described as the Parsons et al. invention. Different kinds of LED's and suggested applications therefore are discussed.

Regardless of levels of intensity, and where they may be placed, light bulbs and LED's will be perceived only as brightly lit spots or flashes; not as actual eyes with pupils and expression. Further, exposed bulbs or diodes may prove unsafe for use by and around small children. Bulbs or LED's may be pulled from their sockets, and could be broken or swallowed by a relatively young child or infant. Moreover, removal of bulbs/diodes from the wiring circuit may, of course, pose further, obvious hazards.

Despite continued advances in toy technology and a growing variety of ancillary features, prior art toys of the plush or doll type fall short of engendering a sense of personal connection on the part of a child or collector. There remains a strong desire among toy users and collectors for a toy animal, doll or the like with a substantially increased capability for conveying a sense or feeling of connectivity and security, and to do so in a safe manner. The present invention effectively resolves the shortcomings and inadequacies of the prior art in satisfying a long felt need.

BRIEF SUMMARY OF THE INVENTION

The invention presented herein is specifically configured and applied to provide a battery powered squeeze-operated plush toy, doll or the like having designated illuminated or glowing parts that represent eyes. A light illuminating source such as a light emitting diode is mounted inside the plush toy's designated glowing parts.

This relatively cool and very safe diode element is positioned beneath or behind an external surface of the toy's designated glowing parts so as to internally illuminate such parts when the light source is activated. A battery powered source is located within the toy with a wiring circuit within the figure that electrically connects the battery power source and the light emitting source.

The battery power source activates the light emitting source when manually pressed. The toy may further include a timing circuit for automatically de-energizing the light source after a predetermined period. For example, and in no way limiting as to the scope of appended claims, such period may be two minutes. In particular, the present invention provides a toy which is safe and especially suitable for use by young children for creative play and especially at bedtime. Such a toy would typically have a pair of eyes, but of course may include only a single eye or perhaps more than two.

In a method of using this unique toy, a small child ready for sleep would engage the toy so as to activate the circuit and illuminate the eyes. The child will continue to enjoy the toy as the room lights are extinguished. If the timing circuit completes its cycle and the illumination of the toy's eyes ceases, the child can simply put manual pressure on the toy to restore illumination and continue creative play until both the child and the toy are "asleep."

The external surface material of the plush toy (beneath which the LED is mounted) is substantially translucent so as to pass light from the LED, thus simulating the eye of the animal or other creature represented by the toy. As an added feature, the external surface further includes a generally opaque portion or region of the simulated eye, which region is formed in the shape of a simulated pupil/iris.

Thus, the effect of the light passing from the LED through the substantially translucent material surface and blocked by the generally opaque region is to display a glowing image of an open eye. The opaque regions may be small or large relative to the overall eye surfaces, and may be relatively positioned in a manner so as to lend entertaining facial expressions to the toy.

BRIEF DESCRIPTION OF THE DRAWINGS

The invention will be best understood by reference to the following detailed description of an illustrative embodiment when read in conjunction with the accompanying drawings, wherein.

DETAILED DESCRIPTION OF THE INVENTION

Figure 1:
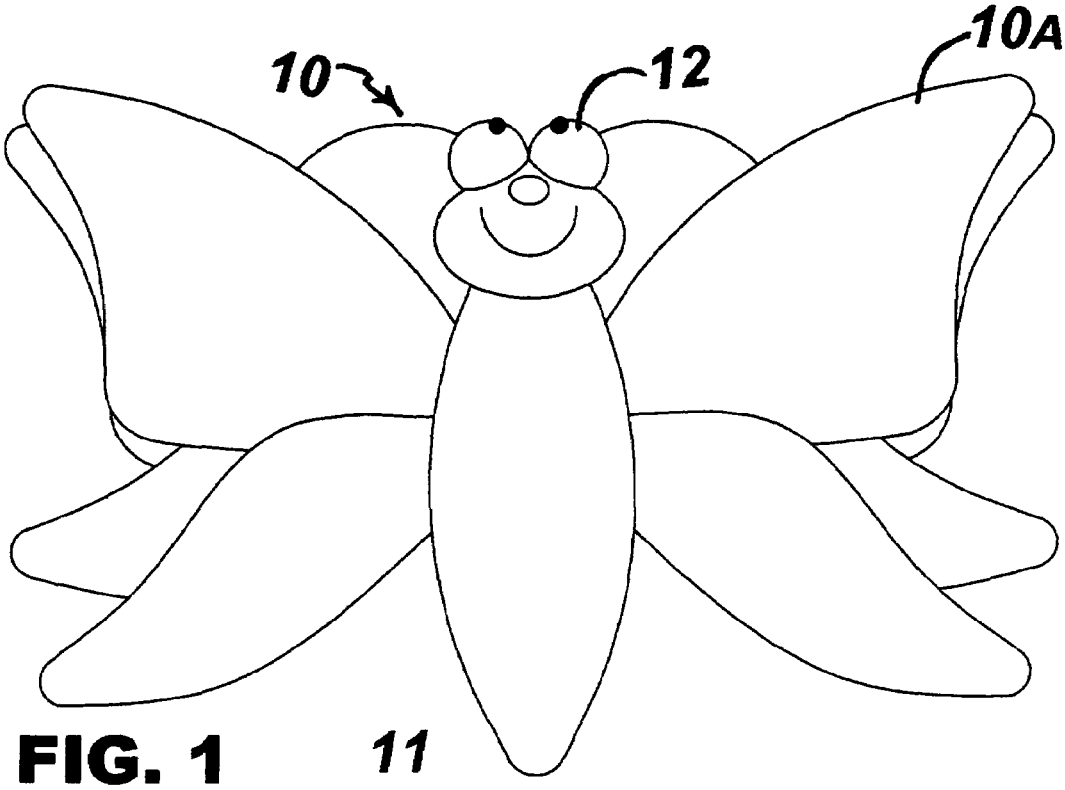
FIG. 1 is a bottom view of the plush toy of the present invention.

The plush toy is illustrated in a bottom view, FIG. 1, in the form of an animated firefly 10 (by way of example) with soft, generally transparent wings 10A and flexible body 11. The flexible body 11 may include soft fabric stitched together in panel sections as is well known in the art. Said panel sections may be formed of any suitable material which may include natural textile cloth or synthetic fabric. Firefly 10 further displays an exterior surface of LED receptacle housings 12 in the form of eyes.

Figure 2:
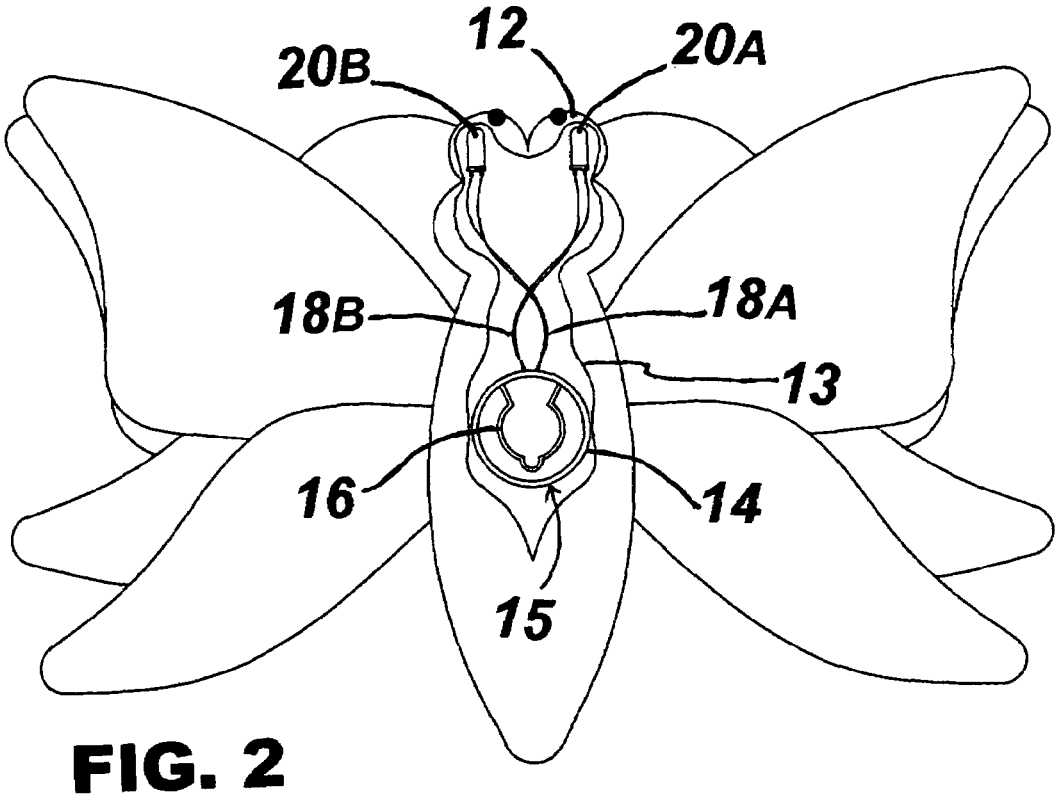
FIG. 2 illustrates the battery powered device in the interior of the plush toy.

FIG. 2 shows a portion 13 of the firefly 10 body 11 removed to reveal an interior housing for the LED control elements 15. Receptacle housings 12 (or "eyes") include eye-defining external fabric panel coverings having inner and outer faces and serving to define the receptacle housings 12 as being significantly larger than said diodes. Such external fabric panel coverings are substantially translucent elements attached or integral with the plush toy material, so as to allow and guide passage of a glowing light from diodes 20A and 20B only through said eye-defining external fabric panel coverings. The eye-defining external fabric panel coverings of receptacle housings 12 further include opaque regions or spots 12A that visually simulate iris/pupil portions of the eyes, and opaque regions 12B simulate eyelids.

The LED control elements 15 include a compression plate 16, battery switch 14 and timing circuit 60, all of which are conventional in the toy art as noted in the prior art discussion hereabove in the discussion of prior art patents, each of which is hereby incorporated by reference. The light emitting devices 20A and 20B within receptacle housings 12 are activated when compression plate 16 is compressed causing battery switch 14 to send signal through wires 18A and 18B interconnected to devices 20A and 20B.

Thus the LED's 20A and 20B project light against the inner face of said substantially translucent external fabric panel coverings of receptacle housings 12. As noted above, the toy body 11 may include an external surface made up of stitched fabric panels. Receptacle housings 12 include substantially translucent fabric panel coverings such that the "eyes" will appear illuminated on the fabric panel covering outer face with a soft glow except where the opaque regions 12A and 12B are located. The contrast between the opaque (light-blocked) and the lighted regions of the receptacle housings 12 distinctly defines images of eyes for the plush toy.

Figure 3:
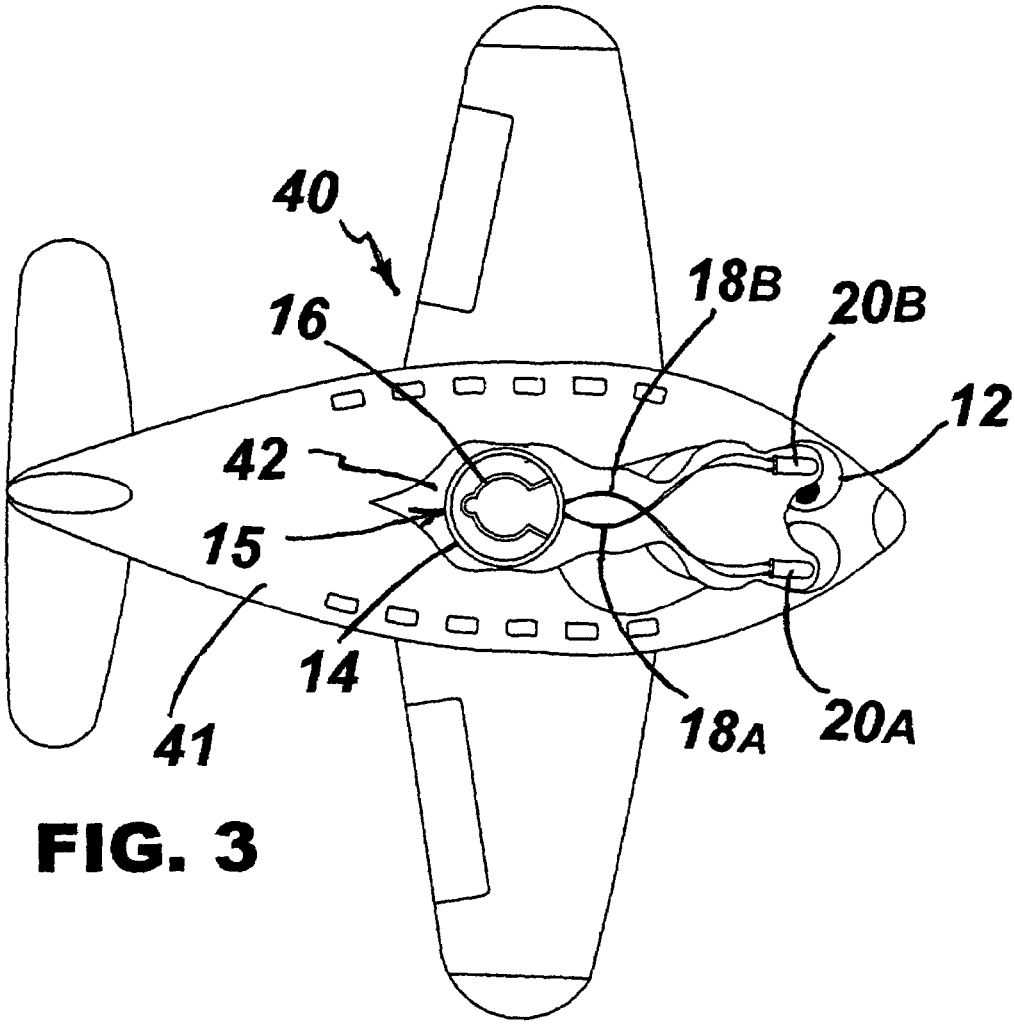
FIG. 3 shows another embodiment of the plush toy of the present invention and the battery powered device in its interior.

FIG. 3 shows a top view of a second embodiment of the present plush toy formed as an animated airplane 40. A portion 42 of the toy airplane body 41 is shown removed to reveal an interior housing for the LED control elements 15. As in the firefly 10 embodiment described above, receptacle housings 12 (or "eyes") are translucent elements attached to or integral with the plush toy airplane so as to permit passage of glowing light from diodes 20A and 20B. Note that opaque spots 12A and 12B are illustrated as simulating an iris/pupil and lid so as to enhance the "eye" effect.

Again, as discussed above, the LED control elements 15 include a compression plate 16, battery switch 14 and timing circuit 60. As noted above, such circuitry for powering an LED through means of a pressure switch, battery and associated wires is well known as demonstrated in the prior art. The LED's 20A and 20B in receptacle housings 12 are activated upon pressure delivered to plate 16. This results in a current feed via wires 18A and 18B acting to energize, or light-up, the LED's.

Light emitted through the external surface of receptacle housings 12 will appear as a soft glow (as opposed to the flash or glare of uncovered bulbs/LED's) since the covering surface is constructed of a translucent material. This creates the display of a softly lit eye, enhanced by the opaque spots 12A that simulate iris and pupil portions of the eyes.

Figure 4:
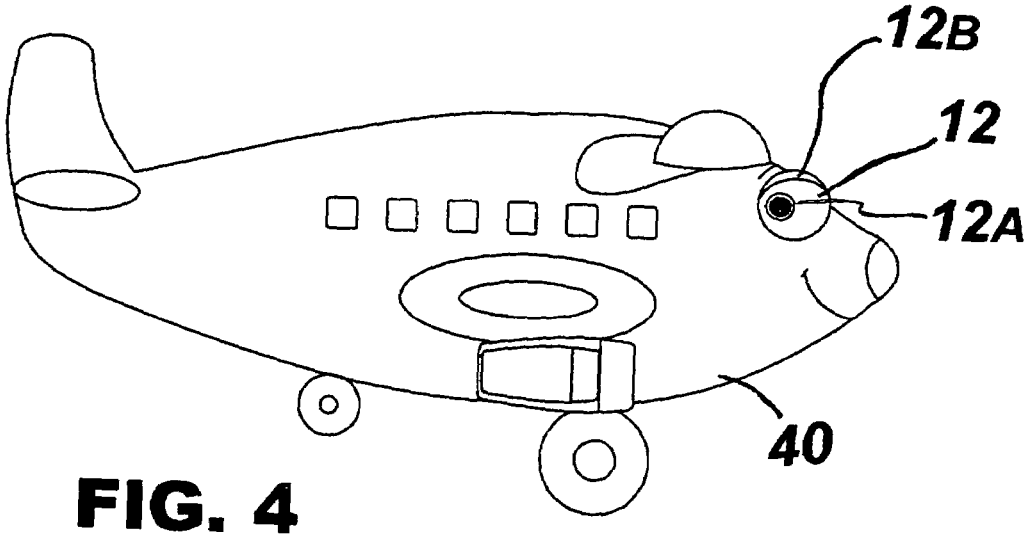
FIG. 4 shows a side view of the plush toy embodied as an airplane.

FIG. 4 illustrates a side view of the airplane plush toy 40, where an eye (receptacle housing 12) is shown with the iris and pupil portion 12A positioned, for example, so as to impart a pleasant whimsical appearance. In the case of airplane 40, the eyes (receptacle housings 12) are placed at a location where a pilot/copilot windshield would be placed (on a real plane).

On simulated trucks and cars (not shown) the eyes (receptacle housings 12) would represent headlights. Thus, a vast variety of vehicles (racecar, ambulance, school bus, fire truck, train engine, police car) and simulated living creatures (honeybee, butterfly, ladybug, caterpillar, grasshopper, bear, dog, cat, horse, donkey, alligator, and so on) can be simulated in applying the present invention, without departing from the scope defined in the appended claims.

It is believed that the most powerful sense of connectivity between humans is through personal touch and interaction between the eyes. The same holds true for humans and certain domestic pets such as dogs and cats. While countless animated toys have been created to be "cuddly" and equipped with lighted eyes (or other specialty features), their connectivity remains minimal, if it exists at all. On the other hand, the present invention with softly backlit, translucent eyes (receptacle housings 12) conveys instant connectivity possibilities. This sense of connection can of course be enjoyed at any playtime, but can be particularly useful at bedtime.

It is well known that most children have difficulty at bedtime when the time for lights to be turned out. Small children find it easier to fall asleep if a night light or other soft light is glowing in the bedroom or shining from an adjacent hallway. They also require the comfort of a cuddly friend in the form of a plush toy or other favorite doll. The present invention employs LED's in a safe, novel and non-obvious way to bring a sense of joy, security and comfort to a small child in transition from wakefulness to sleep.

Once in bed, the child will happily allow the bedroom lights to be extinguished as long as she/he can view the softly glowing eyes of a companion plush toy. The toy playfully simulates animals, insects, reptiles, prehistoric creatures or the like having small light emitting diodes representing eyes. In lieu of a nightlight, the toy eyes are effortlessly energized by simply pressing a body portion of the toy. As the diode circuit timer runs its cycle, the glow will fade as the plush toy "falls asleep." If the child wishes to continue play, the timer cycle may be repeated.

Although various embodiments of the present invention have been described in the foregoing detailed description an illustrated in the accompanying drawings, it will be understood that the invention is not limited to the embodiments disclosed, but may assume numerous arrangements, rearrangements, modifications, and substitutions of steps without departing from the spirit of the invention nor from the scope of the following claims.

I claim:

1. A plush toy comprising:

a flexible body portion and at least one simulated eye;

at least one receptacle housing within said body portion;

at least one light emitting diode located within said at least one receptacle housing;

said diode enclosed at an outside surface of said at least one receptacle housing by an eye-defining external fabric panel covering having an inner and outer face, wherein the at least one diode receptacle housing is significantly larger than said diode;

said eye-defining external fabric panel covering being at least in part substantially translucent and configured to limit transmission of said emitted light to a soft glow and further including at least one generally opaque portion configured in the shape of a simulated pupil/iris to substantially block soft glow emitted when said at least one diode is activated to simulate a soft glowing eye;

said diode receptacle housing and said body portion configured to permit and guide emitted light from said diode through said eye-defining external fabric panel covering, thus forming said simulated eye;

a power source included within said body portion of said plush toy and interconnected to said at least one diode; and a manual pressure switch within said body portion that is configured to activate said power source so as to furnish current to said at least one diode;

whereby pressure on said switch activates said power source, furnishing current to said diode such that light therefrom within said receptacle housing is directed against said inner face of said substantially translucent fabric, eye-defining panel covering, resulting in at least one simulated, softly backlit translucent eye at said outer face of said eye-defining fabric panel covering.

2. The plush toy of claim 1 further defined as including:

a pair of receptacles within said body portion;

a pair of light emitting diodes each respectively positioned within one of said pair of receptacles;

each said receptacle enclosed at an outside surface of said body portion by an eye-defining external fabric panel covering forming in said body portion a pair of diode receptacle housings;

said power source is interconnected to said pair of diodes;

said switch is interconnected to said power source and pair of diodes;

whereby pressure on said switch activates said pair of diodes and causes each said diode receptacle housing to emit a soft glow only at said outer face of said eye-defining fabric panel covering so as to simulate a pair of softly backlit translucent eyes.

3. The plush toy of claim 2 further defined by:

said body portion includes a head, trunk and limbs of a simulated animal;

said diode receptacle housings are located in the head so as to simulate said pair of eyes.

4. The plush toy of claim 1 further including a timer circuit interconnected to said switch;

whereby said timer circuit is configured to limit a time period for switch activation.

5. The plush toy of claim 1 further defined by:

said body portion takes the form of a simulated vehicle with at least one headlight;

said diode receptacle housing being located at a vehicle headlight position and simulating said at least one eye.

6. A method of using a plush toy to induce sleep in a user, the steps comprising:

providing a plush toy including a flexible body portion and at least one simulated eye;

providing said toy with at least one receptacle housing within said flexible body portion;

further providing said toy with at least one light emitting diode located within said at least one receptacle housing;

enclosing said at least one diode at an outside surface of said at least one receptacle housing by an eye-defining external fabric panel covering having an inner and outer face, wherein the at least one diode receptacle housing is significantly larger than said diode;

selecting said eye-defining external fabric panel covering to be at least in part substantially translucent and configuring said external fabric panel covering to limit transmission of said emitted light to a soft glow and further including at least one generally opaque portion configured in the shape of a simulated pupil/iris to substantially block soft glow emitted when said at least one diode is activated to simulate a soft glowing eye;

further configuring said at least one diode receptacle housing and said body portion to permit and guide emitted light from said diode only through said eye-defining external fabric panel covering, thus forming said at least one simulated eye;

including a power source within said body portion and interconnecting said power source to said at least one diode;

further providing said toy with a manual pressure switch within said body portion and configuring said switch for activating said power source so as to furnish current to said at least one diode;

further providing said toy with a timer circuit to begin timed cycles during which said power source is activated; and pressing said switch to activate said power source for said at least one timed cycle furnishing current to said diode such that light therefrom within said receptacle housing is directed against said inner face of said substantially translucent eye-defining fabric panel covering resulting in at least one simulated, softly backlit translucent eye at said outer face of said fabric panel covering;

observing said at least one eye during said at least one timed cycle; and repeating activation of said timed cycles until user's sleep is induced.

* * * * *